US009706312B2

(12) United States Patent
Nicollini

(10) Patent No.: US 9,706,312 B2
(45) Date of Patent: Jul. 11, 2017

(54) SENSING CIRCUIT AND METHOD OF DETECTING AN ELECTRICAL SIGNAL GENERATED BY A MICROPHONE

(71) Applicant: STMicroelectronics S.R.L., Agrate Brianza (IT)

(72) Inventor: Germano Nicollini, Piacenza (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 15 days.

(21) Appl. No.: 14/850,714

(22) Filed: Sep. 10, 2015

(65) Prior Publication Data

US 2016/0173994 A1 Jun. 16, 2016

(30) Foreign Application Priority Data

Dec. 16, 2014 (IT) ..... TO2014A1054

(51) Int. Cl.

| | |
|---|---|
| ***H04R 3/00*** | (2006.01) |
| ***H04R 19/04*** | (2006.01) |
| ***H04R 1/04*** | (2006.01) |
| ***H04R 19/00*** | (2006.01) |

(52) U.S. Cl.

CPC ..... *H04R 19/04* (2013.01); *H04R 1/04* (2013.01); *H04R 19/005* (2013.01); *H04R 2201/003* (2013.01)

(58) Field of Classification Search

CPC ..... H04R 19/005; H04R 19/04; H04R 1/04; H04R 2201/003

USPC ..... 381/111, 122, 120, 113, 174; 330/253, 330/260

See application file for complete search history.

(56) References Cited

U.S. PATENT DOCUMENTS

| | | | | |
|---|---|---|---|---|
| 5,469,104 | A | 11/1995 | Smith et al. | |
| 6,188,211 | B1 | 2/2001 | Rincon-Mora et al. | |
| 6,275,112 | B1 | 8/2001 | Muza | |
| 2006/0044068 | A1 | 3/2006 | Alenin | |
| 2014/0064523 | A1* | 3/2014 | Kropfitsch | H03G 1/0094 381/174 |
| 2014/0119573 | A1 | 5/2014 | Kropfitsch et al. | |

* cited by examiner

*Primary Examiner* — Vivian Chin
*Assistant Examiner* — Friedrich W Fahnert
(74) *Attorney, Agent, or Firm* — Seed IP Law Group LLP

(57) ABSTRACT

A sensing circuit includes: a follower transistor, having a control terminal; a follower terminal for connection to a load; a bias-current generator, coupled to the follower terminal; and a feedback stage, configured to control the bias-current generator as a function of an input signal on the control terminal of the follower transistor.

25 Claims, 3 Drawing Sheets

SENSING CIRCUIT AND METHOD OF DETECTING AN ELECTRICAL SIGNAL GENERATED BY A MICROPHONE

BACKGROUND

Technical Field

The present disclosure relates to a sensing circuit and to a method of detecting an electrical signal generated by a microphone.

Description of the Related Art

As is known, capacitive microphones, in particular MEMS (microelectromechanical systems) microphones and the ECMs (electret capacitor microphones), generally comprise a deformable conductive membrane capacitively coupled to a fixed electrode or plate, also referred to as "back-plate". Present between the membrane and the fixed electrode is a space, occupied by air.

Commonly available capacitive microphones are biased with a fixed charge and produce an electrical signal in response to acoustic signals defined by pressure waves. In practice, the membrane vibrates in response to acoustic signals modifying the capacitance of the capacitor and, given that the charge stored is fixed, the vibration causes a corresponding voltage variation between the electrodes of the capacitor itself. The electrical signal is defined by the voltage variations on the capacitor. An equivalent circuit normally used for representing a capacitive microphone comprises a capacitor with variable capacitance in series to a voltage generator.

In order to prevent perturbation of the charge stored on the capacitor, the electrical signal produced by the microphone is typically read using a sensing circuit (or "buffer") with high input impedance, which drives an external load with a low-impedance output, on the basis of the signal detected.

Sensing circuits most commonly used adopt a MOS transistor in source-follower configuration or, alternatively, a class-AB amplifier.

Sensing circuits based upon a source follower are extremely simple and present a low noise, but prove to be effective only to drive high resistive loads (for example, higher than 100 kΩ). Sensing circuits of this type, in fact, may absorb high currents from (supply high currents to) the load, but, instead, are limited in supplying (absorbing) a current not higher than the bias current of the follower transistor. If the load resistance is modest, prior art circuits typically use a rather high bias current to obtain a sufficient output swing, and this involves an unacceptable increase in static consumption, in the absence of a signal.

Sensing circuits based upon class-AB amplifiers are commonly used for driving low loads, for example lower than 10 kΩ. As compared to source-follower sensing circuits, class-AB amplifiers enable supply of high currents when so desired, maintaining limited consumption levels when the input signal is low or absent. However, class-AB amplifiers are much more complex than source-follower circuits and contain several noise sources. Furthermore, to prevent possible oscillations or instability, a rather elaborate frequency compensation is frequently employed. In practice, also the static consumption is not in general as low as would be desirable.

BRIEF SUMMARY

Some embodiments of the present disclosure provide a sensing circuit and a method of detecting an electrical signal generated by a microphone that enable the limitations described to be overcome or at least attenuated.

One embodiment of the present disclosure is a sensing circuit that includes a follower transistor, a bias current generator, and a feedback stage. The follower transistor has a control terminal and a follower terminal configured to be electrically coupled to a load. The bias current generator is electrically coupled to the follower terminal. The feedback stage is configured to control the bias current generator based on an input signal on the control terminal of the follower transistor.

One embodiment of the present disclosure is a method that includes converting an acoustic signal into a first electrical signal, sensing the first electrical signal, and supplying a second electrical signal based on the first electrical signal. The sensing includes:

supplying the first electrical signal to a control terminal of a follower transistor having a follower terminal coupled to a load (Z);

controlling a bias current generator, coupled to the follower terminal, based on the first electrical signal.

BRIEF DESCRIPTION OF THE SEVERAL VIEWS OF THE DRAWINGS

For a better understanding of the disclosure, an embodiment thereof will now be described, purely by way of non-limiting example, with reference to the attached drawings, wherein.

DETAILED DESCRIPTION

Figure 1:
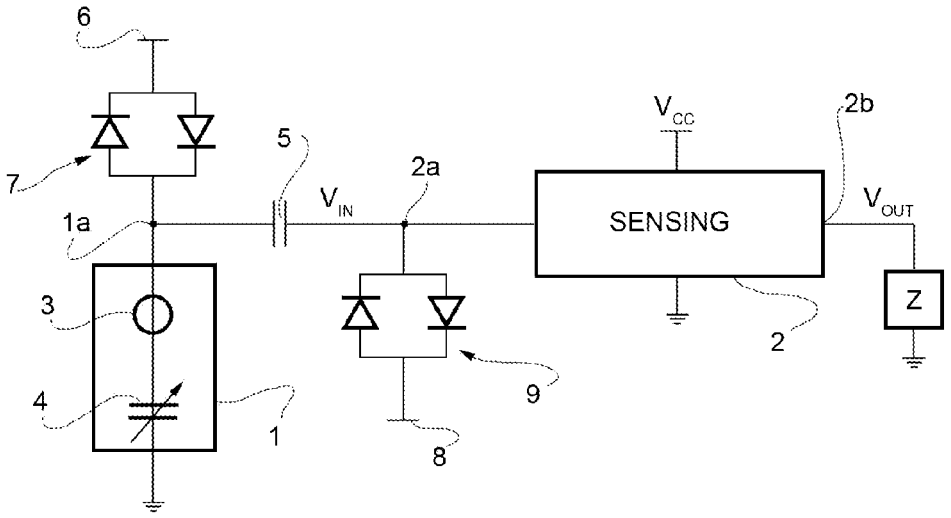
FIG. 1 is a simplified block diagram of a device for transducing acoustic signals.

FIG. 1 is a schematic illustration of a microphone 1 of a capacitive type, for example a MEMS microphone, and a sensing circuit 2 for detection of electrical signals generated by the microphone 1 in response to acoustic signals. The microphone 1 and the sensing circuit 2 form a device for transducing acoustic signals.

The microphone 1 is here represented schematically by the series of a signal generator 3 and a capacitor 4 with variable capacitance. A signal-coupling capacitor 5 provides a signal coupling between a terminal 1*a* of the microphone 1 and an input terminal 2*a* of the sensing circuit 2. The terminal 1*a* of the microphone 1 and the input terminal 2*a* of the sensing circuit 2 are connected, respectively, to a first reference line 6, by a first DC bias stage 7, and to a second reference line 8 by a second DC bias stage 9. The microphone 1 generates an input signal $V_{IN}$, for example a voltage, on the input terminal 2*a* of the sensing circuit 2. The reference line 6 supplies a DC pre-charge voltage $V_{PC}$ for transferring a fixed working charge onto the capacitor 4 with variable capacitance.

A low-impedance output terminal 2*b* of the sensing circuit 2 supplies an output signal $V_{OUT}$, for example a voltage, indicating voltage variations on the capacitor 4 with variable capacitance in response to acoustic signals. The output terminal 2*b* is connected to a load Z.

It is understood in any case that the way of coupling the microphone 1 and the sensing circuit 2 is not necessarily unique, and other connection schemes are possible.

Figure 2:
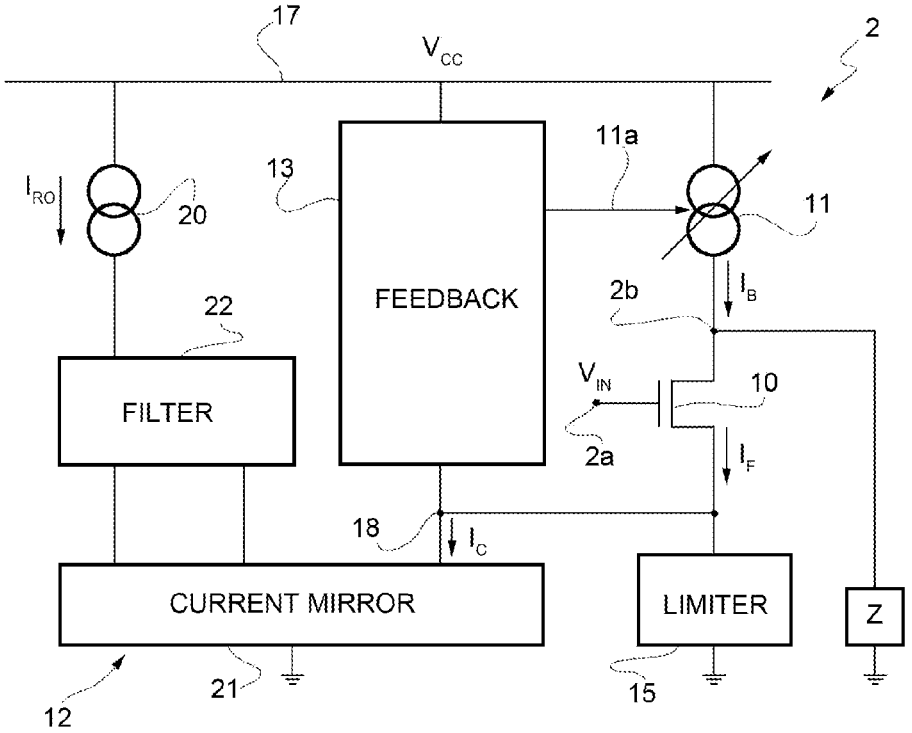
FIG. 2 is a more detailed block diagram of a sensing circuit according to an embodiment of the present disclosure.

FIG. 2 illustrates in a simplified way the sensing circuit 2 according to an embodiment of the present disclosure. The sensing circuit 2 comprises a follower transistor 10, a bias-current generator 11, a reference-generator stage 12, a feedback stage 13, and a limiting or clamp stage 15.

In one embodiment, the follower transistor 10 is a PMOS transistor in source-follower configuration. In practice, the source terminal of the follower transistor 10 (follower terminal) is connected to a first terminal of the bias-current generator 11 and defines the output terminal 2*b* of the sensing circuit 2. The drain terminal of the follower transistor 10 is connected to a comparison node 18, whereas the gate terminal defines the input terminal 2*a* of the sensing circuit 2 and receives the input signal $V_{IN}$ from the microphone 1. The follower transistor 10 conducts a follower current $I_F$.

The bias-current generator 11, which has a second terminal connected to a supply line 17 set at a supply voltage $V_{CC}$, is a controlled generator and supplies a bias current $I_B$ as a function of the amplitude of the input signal $V_{IN}$, as explained in detail hereinafter. The bias-current generator 11 is controlled by the feedback stage 13 on the basis of a balance of currents at the comparison node 18. In practice, the follower current $I_F$ supplied by the follower transistor 10 is compared with a comparison current $I_C$ supplied by the reference-generator stage 12, and the comparison determines the action of control performed by the feedback stage 13 on the bias-current generator 11.

The reference-generator stage 12 comprises a primary reference-current generator 20, a current-mirror circuit 21, and a filter stage 22.

The primary reference-current generator 20 is configured to supply a constant primary reference current $I_{R0}$. The current-mirror circuit 21 supplies to the comparison node 18 the comparison current $I_C$ on the basis of the primary reference current $I_{R0}$. For instance, in one embodiment the comparison current $I_C$ is a multiple of the primary reference current $I_{R0}$.

The filter stage 22 co-operates with the current-mirror circuit 21 for suppressing the noise or disturbance associated to the primary reference current $I_{R0}$.

As has been mentioned, the feedback stage 13 is configured to control the bias current $I_B$ as a function of the input signal $V_{IN}$. In particular, the feedback stage 13 determines an increase of the bias current $I_B$ when, as a result of the input signal $V_{IN}$, the sensing circuit 2 has to supply a current to the load Z.

The limiting stage 15 is connected between the comparison node 18 and a ground line and is configured to prevent the voltage on the comparison node 18 from exceeding a threshold beyond which the follower transistor 10 could operate in a linear area.

Figure 3:
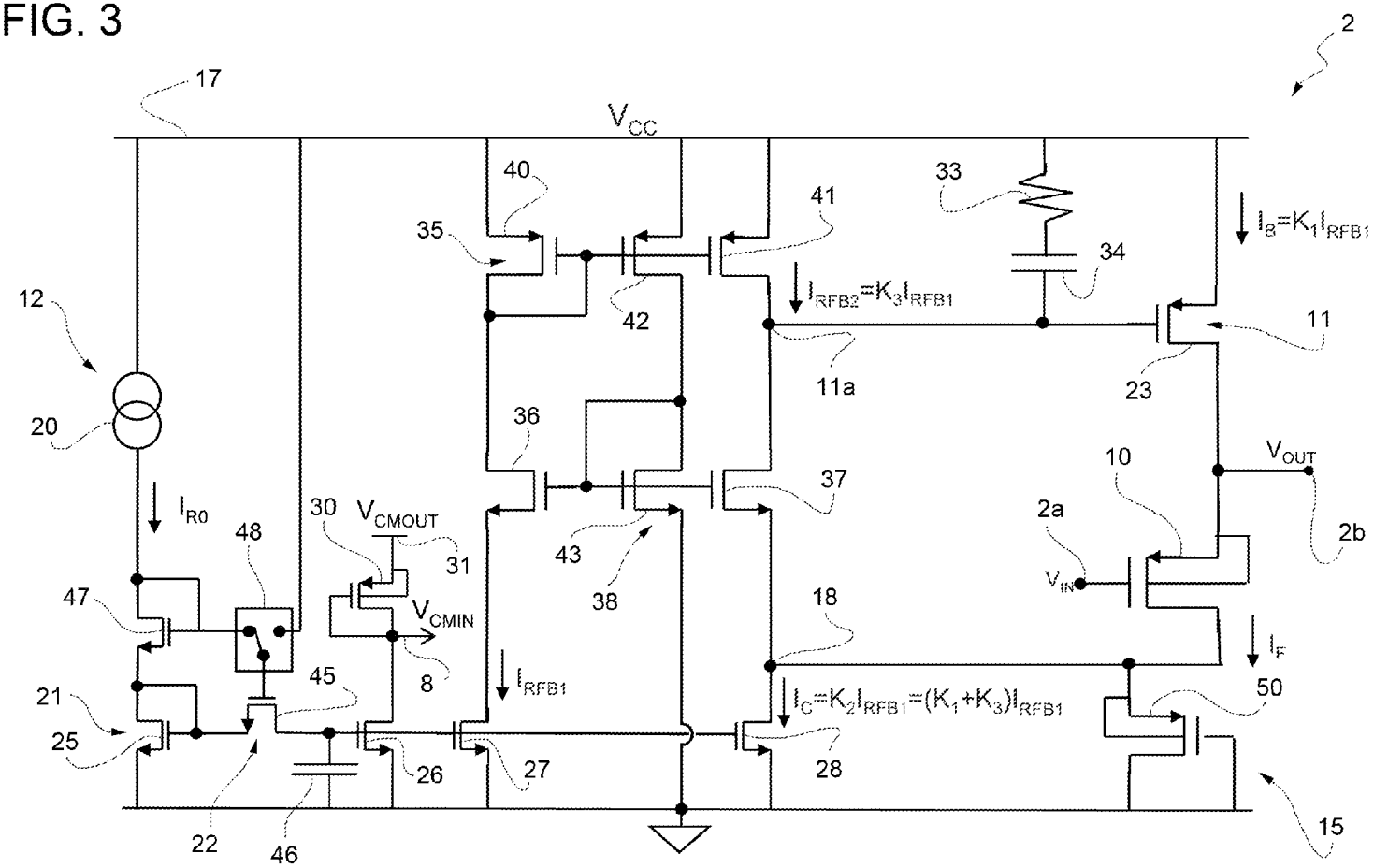
FIG. 3 is a circuit diagram of the sensing circuit of FIG. 2.

FIG. 3 illustrates the sensing circuit 2 in greater detail.

In one embodiment, the bias-current generator 11 comprises a generator transistor 23 of a PMOS type, having its source terminal connected to the supply line 17 and its drain terminal connected to the output terminal 2*b*, in common with the source terminal of the follower transistor 10. The gate terminal of the generator transistor 23 defines a control terminal 11*a* of the bias-current generator 11 and is connected to a node of the feedback stage 13.

In the reference-generator stage 12, the current-mirror circuit 21 comprises a diode-connected transistor 25 and mirror transistors 26, 27, 28, here of an NMOS type, which have the respective gate terminals coupled to the gate terminal of the diode-connected transistor 25. The diode-connected transistor 25 is in series to the primary reference-current generator 20 and receives the primary reference current $I_{R0}$.

A diode-connected transistor 30, here of a PMOS type, is arranged in series to the mirror transistor 26 and has its source terminal connected to a reference line 31, set at an output common-mode voltage $V_{CMOUT}$. The mirror transistor 26 and the diode-connected transistor 30 are sized for fixing, at a desired value, a voltage on the respective drain terminals, which are in common. The common node 8 of the drain terminals defines an input common-mode voltage $V_{CMIN}$, which is used as reference for the input terminal 2*a* in the absence of a signal.

The mirror transistor 27 and the mirror transistor 28 supply reference currents for the feedback stage 13. In one embodiment, in particular, a first feedback reference current $I_{RFB1}$ supplied by the mirror transistor 27 is a replica of the primary reference current $I_{R0}$. The mirror transistor 28, having its drain terminal connected to the comparison node 18, supplies the comparison current $I_C$, which is higher than the first feedback reference current $I_{RFB1}$, as described in what follows.

The feedback stage 13 comprises a current-mirror circuit 35, decoupling transistors 36, 37, and a biasing branch 38.

The current-mirror circuit 35 in turn includes a diode-connected transistor 40 and a mirror transistor 41, of a PMOS type with respective source terminals connected to the supply line 17. The diode-connected transistor 40 and the decoupling transistor 36 are connected in series to the mirror transistor 27 of the current-mirror circuit 21, with the decoupling transistor 36 arranged between the other two. Thus, the diode-connected transistor 40 and the decoupling transistor 36 both conduct the first feedback reference current $I_{RFB1}$.

The mirror transistor 41 has its gate terminal connected to the gate terminal of the diode-connected transistor 40 and its drain terminal connected to the control terminal 11*a* of the bias-current generator 11. The mirror transistor 41 conducts a second feedback reference current $I_{RFB2}$ determined by the relation between the aspect ratios of the mirror transistor 41 itself and of the diode-connected transistor 40, as discussed hereinafter.

A compensation resistor 33 and a compensation capacitor 34 are connected in series between the supply line 17 and the control terminal 11*a* of the bias-current generator 11, and define a compensation network that stabilizes the loop formed by the follower transistor 10, by the bias-current generator 11, and by the feedback stage 13. Any risk of instability is thus prevented.

The decoupling transistor 37 has its conduction terminals connected, respectively, to the drain terminal of the mirror transistor 41 (i.e., to the control terminal 11*a* of the bias-current generator 11) and to the comparison node 18, and its gate terminal connected to the gate terminal of the decoupling transistor 36.

The biasing branch 38 comprises a mirror transistor 42, which is also connected in current-mirror configuration with the diode-connected transistor 40, and a biasing transistor 43. The biasing transistor 43, which is of a diode-connected NMOS type, is arranged in series to the mirror transistor 42 and has its gate terminal in common with the decoupling transistors 36, 37. In practice, the biasing branch 38 fixes the operating point of the decoupling transistors 36, 37.

The filter stage 22 comprises a filter transistor 45, here of an NMOS type, a filter capacitor 46, a biasing transistor 47, and a state switch 48.

The filter transistor 45 is arranged between the gate terminals of the diode-connected transistor 25 and of the mirror transistors 26, 26, 28 of the current-mirror circuit 21. More precisely, the filter transistor 45 has its source terminal connected to the gate terminal of the diode-connected transistor 25 and its drain terminal connected to the gate terminals of the mirror transistors 26, 27, 28. Through the state switch 48, the gate terminal of the filter transistor 45 may be alternatively coupled to the supply line 17, during a start-up step, and to a gate terminal of the biasing transistor 47. The biasing transistor 47 is diode-connected, in series between the primary reference-current generator 20 and the diode-connected transistor 25, and fixes the operating point of the filter transistor 45, in normal operating conditions. The state switch 48 may be switched, for example, by a signal supplied by an external processing unit (not illustrated) or else when an internal electrical quantity reaches a threshold. The filter capacitor 46 is connected between the drain terminal of the filter transistor 45 and the ground line.

In the start-up configuration, the filter transistor 45 has its gate terminal connected to the supply line 17, and thus its series resistance is very low. The filter stage is in a first state, in which the time constant RC, determined by the filter transistor 45 itself and by the filter capacitor 46, is low and enables the electrical quantities to reach the operating values rapidly. In normal operating conditions, instead, the gate terminal of the filter transistor 45 is connected to the gate terminal of the biasing transistor 47, which is sized in such a way that the filter transistor 45 will operate below threshold, with high series resistance. The filter stage 22 is thus set in a second state, in which the time constant RC of the filter transistor 45 and of the filter capacitor 46 is very high and enables suppression of the effects of fluctuations of the primary reference current $I_{R0}$ on the comparison current $I_C$ and on the first feedback reference current $I_{RFB1}$.

In one embodiment, the limiting stage 15 comprises a limiting transistor 50 of a PMOS type, having its source terminal connected to the comparison node 18 and its drain and gate terminals connected to the ground line. In this way, the voltage on the comparison node 18 is limited to the value of the threshold voltage of the limiting transistor 50.

The aspect ratios (W/L) of the transistors that form the reference-generator stage 12 and the feedback stage 13 may be selected in such a way that, apart from the comparison current $I_C$, the currents circulating in the reference-generator stage 12 and in the feedback stage 13 will be significantly lower than the current of the bias-current generator 11 and of the follower transistor 10. This solution enables reduction to a considerable extent of the static consumption of the sensing circuit 2.

In one embodiment, for example, the generator transistor 23, which forms the bias-current generator 11, has an aspect ratio greater by a scale factor $K_1$ (for example, 15) than the aspect ratio of the diode-connected transistor 40 of the current-mirror circuit 35. In the current-mirror circuit 21, the mirror transistor 28, which supplies the comparison current $I_C$, has an aspect ratio greater by a factor $K_2$ than the mirror transistor 27, which supplies the first feedback reference current $I_{RFB1}$. Finally, the aspect ratio of the mirror transistor 41 is linked to the aspect ratio of the diode-connected transistor 40 by a scale factor $K_3$.

In the absence of input signal ($V_{IN}$=0) and with zero current transfer to the load Z, the bias current $I_B$ is $K_1 I_{RFB1}$ and is equal to the follower current $I_F$. Consequently, the comparison current $I_C$ is given by:

$$I_C = I_{RFB2} + I_B = K_3 I_{RFB1} + K_1 I_{RFB1} = (K_3 + K_1) I_{RFB1} = K_2 I_{RFB1}$$

with $K_2 = K_3 + K_1$.

In one embodiment, the scale factor $K_3$ is equal to 1 and the scale factor $K_2$ is equal to $K_1$+1. Furthermore, the mirror transistor 26 has the same aspect ratio as the diode-connected transistor 25. Consequently, the primary reference current $I_{R0}$ and the first feedback reference current $I_{RFB1}$ are the same as one another. The relations expressed regarding the aspect ratios are not, however, to be considered necessary constraints given that they may in effect be modified.

With the relations between the aspect ratios indicated above, the second feedback reference current $I_{RFB2}$ that flows in the mirror transistor 41 of the current-mirror circuit 35 is equal to the first feedback reference current $I_{RFB1}$, whereas the comparison current $I_C$ is equal to $K_2 I_{RFB1} = (K_1 + 1) I_{RFB1}$.

When the input signal $V_{IN}$ is positive, the gate-to-source voltage $V_{GSF}$ of the follower transistor 10 decreases, causing a corresponding reduction of the follower current $I_F$. Given that the comparison current $I_C$ and the second feedback reference current $I_{RFB2}$ through the mirror transistor 41 are fixed, as a result of the reduction of the follower current $I_F$, the voltage on the control terminal 11*a* of the bias-current generator 11 tends to decrease, and thus the gate-to-source voltage $V_{GSB}$ of the generator transistor 23 tends to increase. Consequently, also the bias current $I_B$ increases, which is absorbed in part or entirely by the load Z, according to the amplitude of the input signal $V_{IN}$.

Instead, when the input signal $V_{IN}$ is negative, the gate-to-source voltage $V_{GSF}$ of the follower transistor 10 increases, causing the follower current $I_F$ to increase. The voltage on the control terminal 11*a* of the bias-current generator 11 thus tends to increase and reduces the bias current $I_B$ until the generator transistor 23 is turned off if the amplitude of the input signal $V_{IN}$ so requires. The follower transistor may thus absorb from the load Z an amount of the current that makes the output signal $V_{OUT}$ correspond to the input signal $V_{IN}$. Furthermore, the limiting transistor 50 prevents the voltage on the comparison node 18 from increasing until the follower transistor 10 is brought to function in a linear area when the follower current $I_F$ is high. In practice, in a limiting operating condition, the voltage on the comparison node 18 is limited to the gate-to-source voltage of the limiting transistor 50, thus enabling a further increase of the follower current $I_F$, if required by the negative value of the input signal. Instead, the limiting transistor 50 is off and does not consume energy in the other operating conditions when the input signal $V_{IN}$ is positive, or else is negative, but not sufficiently high in modulus as to bring the comparison node 18 above the threshold voltage of the limiting transistor 50 itself.

The sensing circuit 2 described combines the advantages of class-AB amplifiers and of follower-based circuits. On the one hand, in fact, as in class-AB circuits, control of the bias-current generator 11 as a function of the input signal $V_{IN}$ enables, if need be, high currents to be supplied to the load Z. Instead, the consumption of current of the bias-current generator 11 may be reduced when the sensing circuit 2 is absorbing current from the load Z or is supplying modest currents. On the other hand, the sensing circuit 3 has a very simple structure that is intrinsically not very subject to noise, as is the case of follower circuits. Furthermore, the filter stage 22 enables suppression of the fluctuations of the primary reference current $I_{RO}$, thus further improving immunity to noise.

A further advantage is represented by the limiting stage 15, which enables the follower transistor 10 to absorb high currents without reaching working conditions critical for saturation.

The sensing circuit 2 is thus suited to driving even modest resistive loads, maintaining low consumption levels and low noise.

Figure 4:
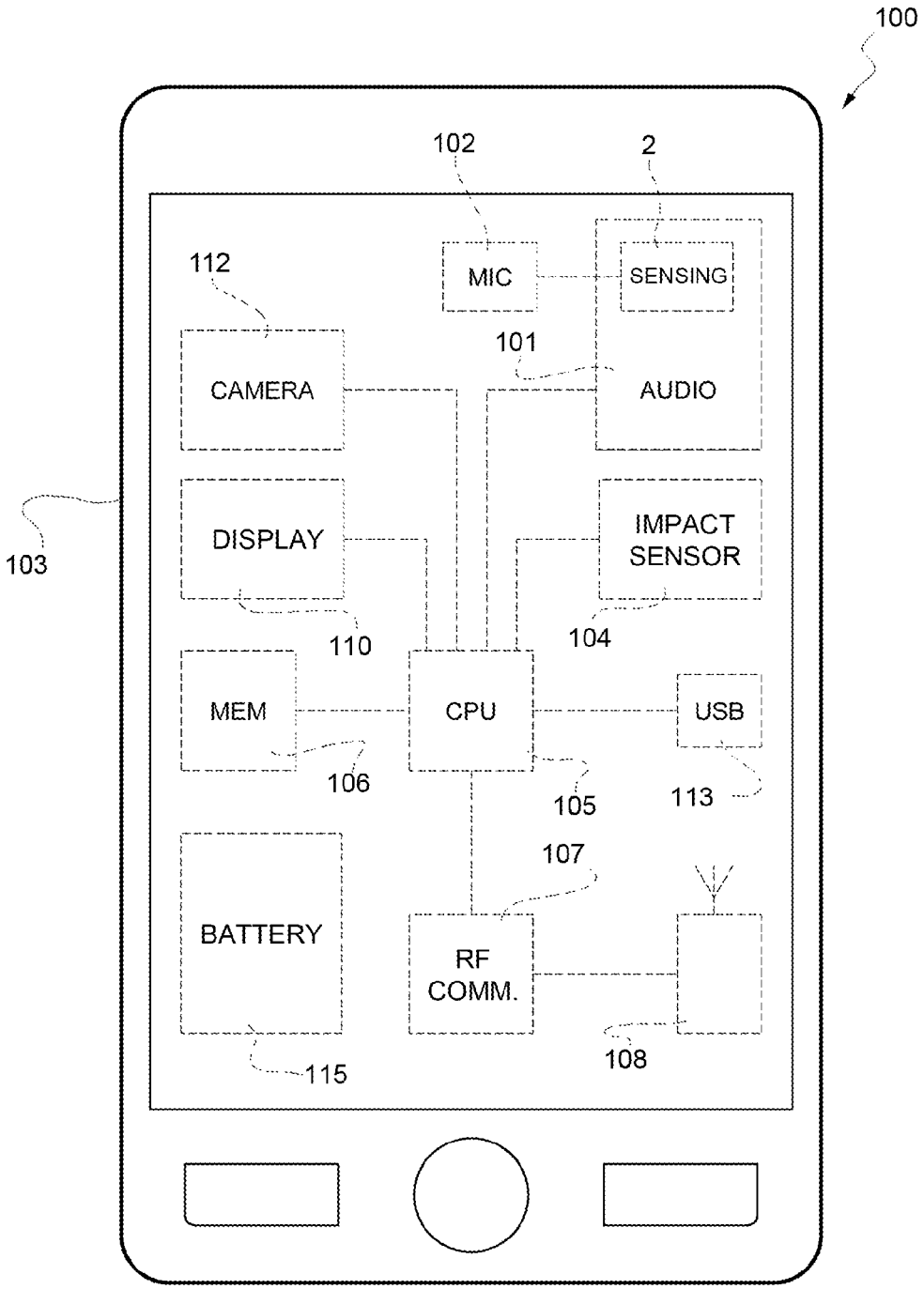
FIG. 4 is a simplified block diagram of an electronic system incorporating a sensing circuit according to one embodiment of the present disclosure.

FIG. 4 illustrates an electronic system 100 incorporating the sensing circuit 2 described.

The electronic system 100 may be an electronic device of any type, in particular portable and supplied autonomously, such as, by way of non-limiting example, a cellphone, a portable calculator, a video camera, a photographic camera, a multimedia reader, a portable apparatus for video games, a motion-activated user interface for computers or consoles for video games, a satellite navigation device. In the embodiment of FIG. 4, the electronic system 100 is a cellphone.

The sensing circuit 2 may be incorporated in an acquisition interface of an audio module 101 and coupled to a microphone 102.

The electronic system 100 may further comprise; a housing 103, to which an impact sensor 104 is rigidly coupled; a control unit 105; a memory module 106; an RF communication module 107 coupled to an antenna 108; a display 110; a filming device 112; a serial connection port 113, for example a USB port; and a battery 115 for autonomous supply.

The control unit 105 co-operates with the microphone 102 and the sensing circuit 2, for example exchanging signals with the audio module 101.

It should be noted that the scope of the present disclosure is not limited to embodiments that specifically have one of the devices listed or all of them as a whole.

Finally, it is evident that modifications and variations may be made to the sensing circuit and to the detection method described herein, without departing from the scope of the present disclosure. In particular, it is clear that the sensing circuit could be obtained in a complementary way, with conductivity of the components, voltages, and currents opposite to what has been described.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A sensing circuit comprising:

a follower transistor having a control terminal and a follower terminal configured to be electrically coupled to a load;

a bias current generator electrically coupled to the follower terminal and configured to supply a bias current;

a controller feedback-coupled between the follower transistor and the bias current generator and configured to control the bias current generator and modify the bias current based on an input signal on the control terminal of the follower transistor;

a comparison node, the follower transistor being configured to supply a follower current to the comparison node; and a reference generator stage configured to supply a comparison current to the comparison node, the controller being configured to modify the bias current based on a current balance at the comparison node.

2. The sensing circuit according to claim 1, wherein the reference generator stage is configured to supply a first feedback reference current to the controller and supply a second feedback reference current to the comparison node based on the first feedback reference current.

3. The sensing circuit according to claim 2, wherein the reference generator stage comprises:

a primary reference generator configured to supply a primary reference current; and a first current mirror circuit coupled to the primary reference generator for receiving the primary reference current and configured to generate the comparison current and the first feedback reference current based on the primary reference current.

4. The sensing circuit according to claim 3, wherein the controller comprises a second current mirror circuit configured to generate the second feedback reference current from the first feedback reference current.

5. The sensing circuit according to claim 4, wherein:

the first current mirror circuit comprises a first diode-connected transistor coupled to the primary reference generator for receiving the primary reference current, a first mirror transistor configured to supply the first feedback reference current, and a second mirror transistor configured to supply the comparison current; and the second current mirror circuit comprises a second diode-connected transistor coupled to the first mirror transistor for receiving the first feedback reference current, and a third mirror transistor configured to supply the second feedback reference current to the comparison node.

6. The sensing circuit according to claim 5, wherein:

the bias current generator comprises a generator transistor having an aspect ratio greater by a first scale factor than an aspect ratio of the second diode-connected transistor; and the second mirror transistor has an aspect ratio grater by a second scale factor than an aspect ratio of the first mirror transistor; and the second diode-connected transistor and the third mirror transistor have respective aspect ratios related by a third scale factor.

7. The sensing circuit according to claim 6, wherein the reference generator stage is configured to generate the comparison current at a greater level than the bias current and the bias current generator is configured to generate the bias current at a greater level than the first feedback reference current.

8. The sensing circuit according to claim 7, wherein the bias current generator is configured to generate the bias current:

$$I_B = K_1 I_{RFB1}$$

where $I_B$ is the bias current, $I_{RFB1}$ is the first feedback reference current and $K_1$ is the first scale factor.

9. The sensing circuit according to claim 7, wherein the reference generator stage is configured to generate the comparison current:

$$I_C = K_2 I_{RFB1}$$

where $I_C$ is the comparison current, $I_{RFB1}$ is the first feedback reference current and $K_2$ is the second scale factor.

10. The sensing circuit according to claim 6, wherein the first scale factor, the second scale factor and the third scale factor are bound by the relation:

$$K_2=K_1+K_3$$

where $K_1$ is the first scale factor, $K_2$ is the second scale factor and $K_3$ is the third scale factor.

11. The sensing circuit according to claim 3, comprising a filtering stage configured to attenuate effects of fluctuations of the primary reference current on the comparison current and on the first feedback reference current.

12. The sensing circuit according to claim 11, wherein the filtering stage comprises a state switch configured to switch the filtering stage between a first state, in which the filtering stage has a first time constant, and a second state, in which the filtering stage has a second time constant, different from first time constant.

13. The sensing circuit according to claim 11, comprising a limiting stage configured to limit a voltage on the comparison node.

14. The sensing circuit according to claim 13, wherein the limiting stage comprises a limiting transistor configured to be on in a limiting operative condition and to remain off otherwise.

15. An electrical signal transducer comprising a capacitive microphone and a sensing circuit coupled to the capacitive microphone, the sensing circuit including:

a follower transistor having a control terminal and a follower terminal configured to be electrically coupled to a load;

a bias current generator electrically coupled to the follower terminal and configured to supply a bias current;

a controller feedback-coupled between the follower transistor and the bias current generator and configured to control the bias current generator and modify the bias current based on an input signal on the control terminal of the follower transistor;

a comparison node, the follower transistor being configured to supply a follower current to the comparison node; and a reference generator stage configured to supply a comparison current to the comparison node, the controller being configured to modify the bias current based on a current balance at the comparison node.

16. The electrical signal transducer according to claim 15, wherein the reference generator stage is configured to supply a first feedback reference current to the controller and supply a second feedback reference current to the comparison node based on the first feedback reference current.

17. The electrical signal transducer according to claim 16, comprising:

a limiting transistor configured to limit a voltage on at the comparison node.

18. An electronic system comprising a capacitive microphone, a sensing circuit coupled to the capacitive microphone, and a control unit coupled to the sensing circuit, the sensing circuit including:

a follower transistor having a control terminal and a follower terminal configured to be electrically coupled to a load;

a bias current generator electrically coupled to the follower terminal and configured to supply a bias current; and a controller feedback-coupled between the follower transistor and the bias current generator and configured to control the bias current generator and modify the bias current based on an input signal on the control terminal of the follower transistor;

a comparison node, the follower transistor being configured to supply a follower current to the comparison node; and a reference generator stage configured to supply a comparison current to the comparison node, the controller being configured to modify the bias current based on a current balance at the comparison node.

19. The electronic system according to claim 18, wherein the reference generator stage is configured to supply a first feedback reference current to the controller and supply a second feedback reference current to the comparison node based on the first feedback reference current.

20. The electronic system according to claim 19, comprising:

a limiting transistor configured to limit a voltage on at the comparison node.

21. A method, comprising:

converting an acoustic signal into a first electrical signal;

sensing the first electrical signal; and supplying a second electrical signal based on the first electrical signal;

wherein sensing comprises:

supplying the first electrical signal to a control terminal of a follower transistor having a follower terminal coupled to a load;

supplying a bias current from a bias current generator to the follower terminal;

supplying a follower current from the follower transistor to a comparison node;

supplying a comparison current from a reference generator stage to the comparison node; and modifying the bias current based on a current balance at the comparison node.

22. The method according to claim 21, comprising limiting a voltage at the comparison node using a limiting transistor coupled to the comparison node.

23. A circuit comprising:

a follower transistor having a control terminal, a first conduction terminal configured to be electrically coupled to a load, and a second conduction terminal;

a bias current generator electrically coupled to the first conduction terminal and configured to supply a bias current, the bias current generator including a control terminal;

a feedback transistor coupled between the second conduction terminal and the control terminal of the bias current generator and configured to control the bias current generator based on an output of the follower transistor; and a limiting transistor configured to limit a voltage at the second conduction terminal.

24. The circuit according to claim 23, comprising:

a first current mirror coupled to the feedback transistor and the control terminal of the bias current generator; and a reference generator stage configured to supply a comparison current to a comparison node coupled to the second conduction terminal of the follower transistor and a first feedback reference current to the first current mirror, wherein the first current mirror is configured to supply a second feedback reference current to the comparison node, via the feedback transistor, based on the first feedback reference current.

25. The circuit according to claim 24, wherein the reference generator stage comprises:

a primary reference generator configured to supply a primary reference current; and a second current mirror coupled to the primary reference generator for receiving the primary reference current and configured to generate the comparison current and the first feedback reference current based on the primary reference current.

* * * * *